US008562048B2

(12) United States Patent
Cronian

(10) Patent No.: US 8,562,048 B2
(45) Date of Patent: Oct. 22, 2013

(54) REEL LIFTING DEVICE AND METHOD

(75) Inventor: Rodger Cronian, Bakersfield, CA (US)

(73) Assignee: Reel Lift, LLC, Bakersfield, CA (US)

( * ) Notice: Subject to any disclaimer, the term of this patent is extended or adjusted under 35 U.S.C. 154(b) by 217 days.

(21) Appl. No.: 13/267,563

(22) Filed: Oct. 6, 2011

(65) Prior Publication Data

US 2013/0089402 A1 Apr. 11, 2013

(51) Int. Cl.
*B66C 1/00* (2006.01)
*B66C 1/54* (2006.01)

(52) U.S. Cl.
USPC ..... 294/97

(58) Field of Classification Search
USPC ..... 294/86.24, 93, 95, 97, 116, 118
See application file for complete search history.

(56) References Cited

U.S. PATENT DOCUMENTS

| | | | | |
|---|---|---|---|---|
| 3,132,890 | A * | 5/1964 | Beaudet | 294/86.4 |
| 3,307,871 | A * | 3/1967 | Russell et al. | 294/86.4 |
| 4,838,595 | A * | 6/1989 | Spillar | 294/90 |
| 5,332,272 | A * | 7/1994 | Prince | 294/97 |
| 6,439,632 | B1 * | 8/2002 | Webber | 294/97 |

* cited by examiner

*Primary Examiner* — Stephen Vu
(74) *Attorney, Agent, or Firm* — James M. Duncan, Esq.; Klein DeNatale Goldner

(57) ABSTRACT

A device 10 for engaging an object having an opening through a surface of the object includes a first pivotable hook 12 with a collar 16 and a point 26, the first hook 12 having a bend 24 between the collar 16 and the point 26. The first pivotable hook 12 also includes an opening 22 at or near the bend 24 of the first pivotable hook 12. The device also includes a second pivotable hook 14 with a collar 28 and a point 38, the second hook 14 having a bend 36 between the collar 28 and the point 38 and also having an opening 34 at or near the bend 36 of the second pivotable hook 14. A fastener 40 extends through the openings 22 and 34 at or near bends 24 and 36 of the pivotable hooks 12 and 14 such that the first and second pivotable hooks 12 and 14 are able to pivot around fastener 40.

7 Claims, 4 Drawing Sheets

REEL LIFTING DEVICE AND METHOD

CROSS-REFERENCE TO RELATED APPLICATIONS

Not Applicable.

BACKGROUND OF THE INVENTION

The present invention relates generally to a device for lifting objects, and more particularly to a device adapted to be inserted into an opening in a surface of an object to be lifted and to engage an underside of the surface.

Cable reels are routinely used in the art for storage and transportation of various cables, including electrical cables and communications cables. Cable reels are generally constructed from wood, though steel reels are sometimes used. A typical reel includes a central cylindrical drum with flanges at either end. Cable is wound around the exterior surface of the central drum and protected by the flanges.

Because the cables stored and transported on cable reels are generally heavy, the cable reel itself must be constructed of heavy material in order to support the weight of the cable. This weight presents difficulties in terms of lifting or transporting the cable wheel. An opening is generally provided in the cable reel extending through both flanges and the center of the central drum itself, such that rotating shafts for turning the reel, or devices for transport of the reel, may be utilized with the cable reel.

Devices exist for aiding in lifting or transport of cable reels. Such devices are often relatively complex, expensive, and have numerous parts that are subject to malfunction. What is needed is a simple, easily constructed device for lifting cable reels and other objects having openings in a surface thereof.

SUMMARY OF THE INVENTION

The present invention provides a device and method for engaging an object having an opening through a surface of the object. The device includes a first pivotable hook with a collar and a point, the first hook having a bend between the collar and the point. The first pivotable hook also includes an opening at or near the bend of the first pivotable hook. The device also includes a second pivotable hook with a collar and a point, the second hook having a bend between the collar and the point and also having an opening at or near the bend of the second pivotable hook. A fastener extends through the openings at or near the bends in the hooks such that the first and second pivotable hooks are able to pivot around the fastener.

In one aspect of the invention, the first and second pivotable hooks are fastened so that when the collars of the first and second hooks are substantially aligned, the points of the first and second pivotable hooks extend in substantially the opposite direction.

In another aspect of the invention, the first and second pivotable hooks are mirror images of one another when in operable configuration.

Another aspect of the present invention provides a method of lifting an object that has an opening extending through a surface of the object. The method includes the steps of providing a device as described above, pivoting the first and second pivotable hooks so that the longitudinal axes of the portions of each hook extending from the bend to the point are substantially parallel, inserting the portions of each hook extending from the bend to the point into the opening of the object to be lifted, pivoting the first and second pivotable hooks so that the collars of the hooks are substantially aligned, and lifting the object by applying an upward force to the collars of the device.

In another aspect of the invention, the first and second pivotable hooks each include a shank that extends from the collar of the hook to the point of the hook. The portions of the shanks that extend from the collar of the hook to the bend of the hook are substantially perpendicular to the portions that extend from the bend of the hook to the point of the hook. Each pivotable hook includes an opening at or near the bend of the hook through which a fastener extends so that the first and second hooks are able to pivot around the fastener.

DETAILED DESCRIPTION OF THE EMBODIMENTS

As used herein, the term "collar" refers to any suitable configuration at one end of a pivotable hook of the present device such that the pivotable hook can be engaged by a cable, rope, line, clasp, or other structure used to impart an upward force on the present device when used to lift an object. The use of the term "collar" herein does not imply a closed structure, nor does it imply a rounded or circular structure. The drawings associated herewith that show a circular, closed configuration of a collar are meant to be exemplary and not limiting. The term "collar," as used herein, may refer to an open structure or a closed structure having any suitable geometric configuration.

Figure 1:
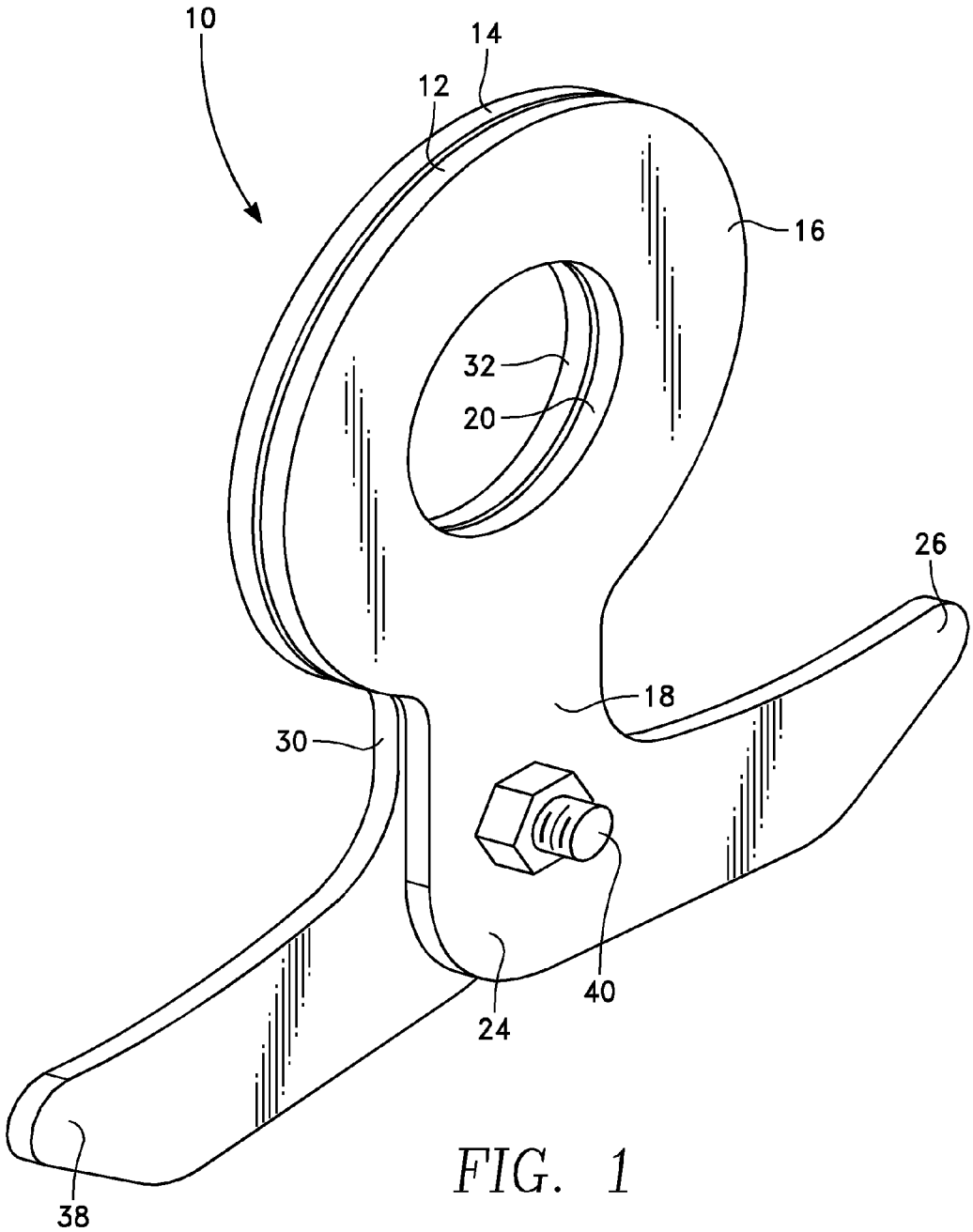
FIG. 1 is a perspective view of one embodiment of a device constructed in accordance with the teachings of the present invention.

The present invention provides a device and method for engaging an object having an opening through a surface thereof. Turning to the drawings, wherein like numerals indicate like parts, FIG. 1 is a perspective view of one embodiment of a device constructed in accordance with the teachings of the present invention. The numeral 10 refers generally to a reel lifting device of the present invention. Device 10 includes a first pivotable hook 12, a second pivotable hook 14, and a fastener 40. First pivotable hook 12 is shown to include a first collar 16, first bend 24, and first point 26. Second pivotable hook 14, includes a second collar 28 and second bend 36, both of which are better shown in FIG. 2, below, as well as second point 38.

Figure 2:
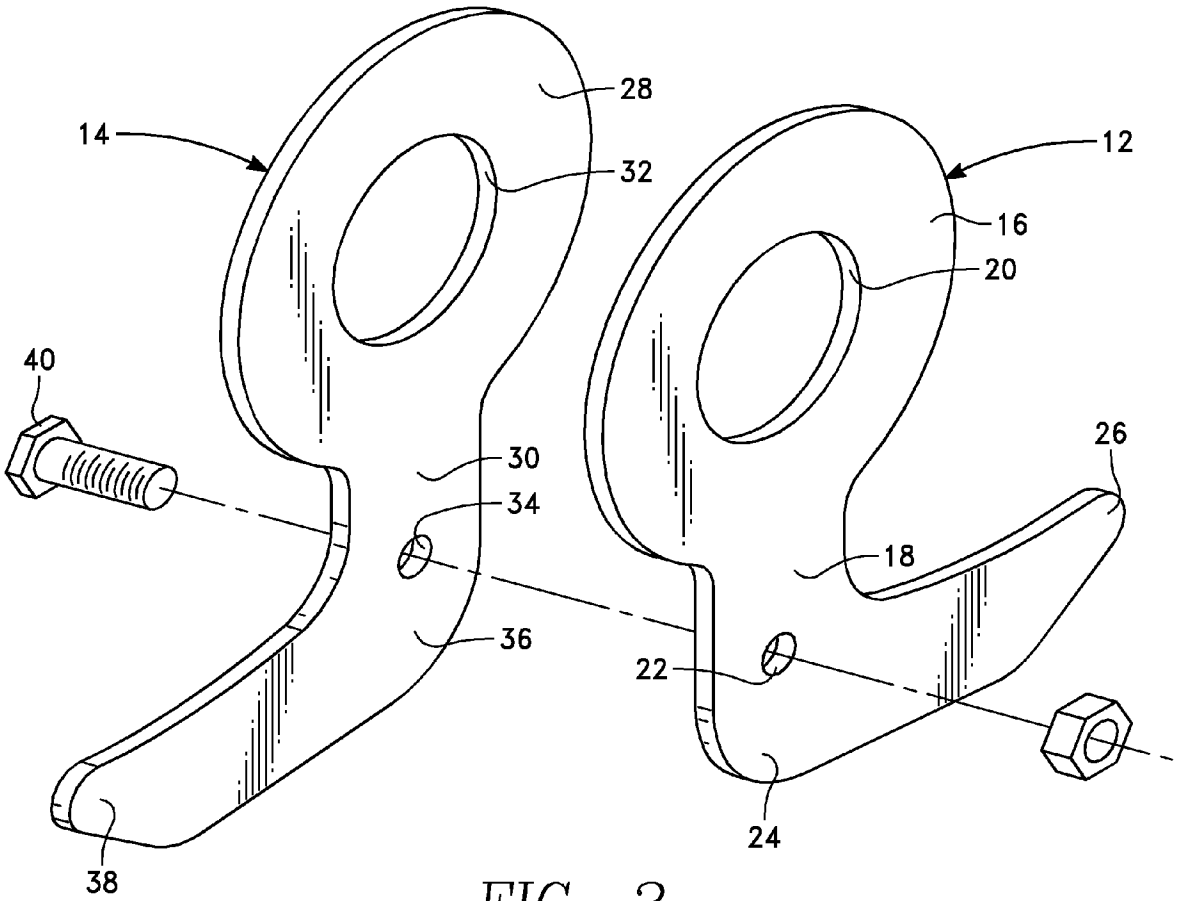
FIG. 2 is an exploded view of one embodiment of a device constructed in accordance with the teachings of the present invention.

Device 10 is shown in FIG. 1 in operable configuration as contemplated when device 10 engages an object to be lifted. The upper surfaces of the portions of the two pivotable hooks 12 and 14 extending from the bends of the hooks to points 26 and 38 provide seats for the underside of a surface of the object to be lifted. First and second collars 16 and 28 include openings 20 and 32, respectively. When first and second collars 16 and 28 are substantially aligned, a wire, cable, line, or other structure can pass through both openings 20 and 32 and be used to exert an upward force against first and second collars 16 and 28 of device 10, thereby lifting the object to be lifted. As shown in FIG. 2, first and second pivotable hooks 12 and 14 preferably include first and second openings 22 and 34, respectively, through which fastener 40 extends, allowing first and second pivotable hooks 12 and 14 to pivot around fastener 40. First and second openings 22 and 34 are preferably located at or substantially near bends 24 and 36 of first and second pivotable hooks 12 and 14, respectively.

In some embodiments of the present invention, first and second pivotable hooks 12 and 14 can be described as including first and second shanks 18 and 30, respectively. First and second shanks 18 and 30 each respectively extend away from collars 16 and 28, form bends 24 and 36, and then extend to points 26 and 38. The portions of shanks 18 and 30 that extend between bends 24 and 36 to points 26 and 38, respectively, are preferably substantially perpendicular to the portions of shanks 18 and 30 that extend from collars 12 and 14 to bends 24 and 36, respectively.

Figure 3:
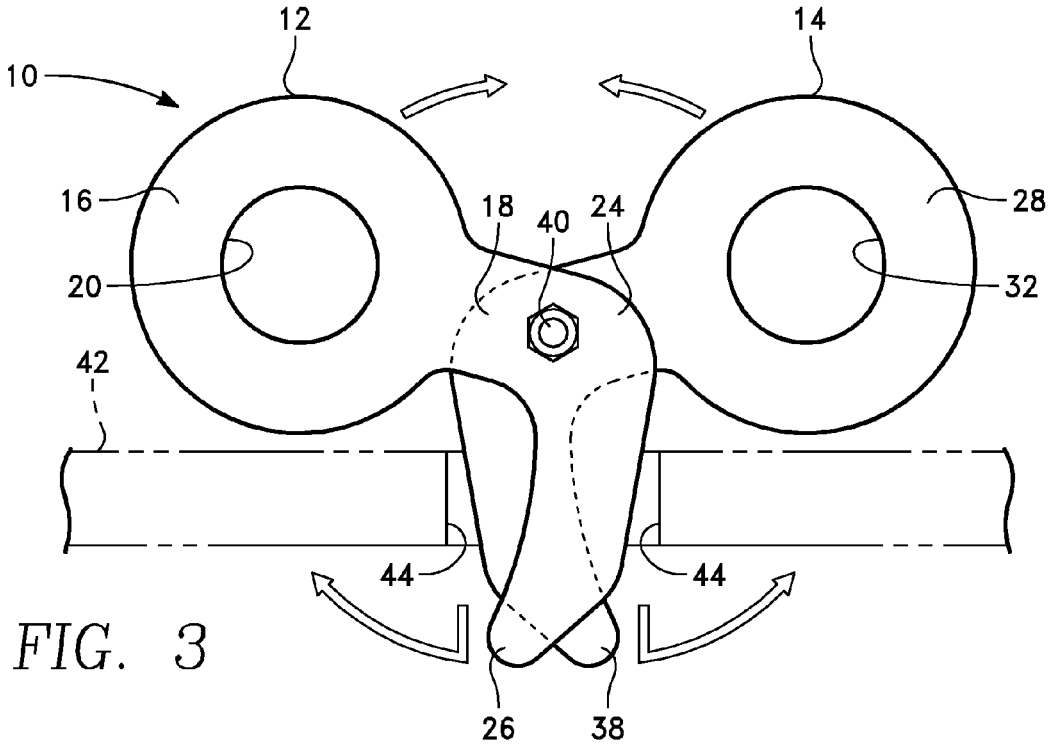
FIG. 3 is an elevational view of one embodiment of a device of the present invention positioned to be inserted into an opening of an object to be lifted.
Figure 4:
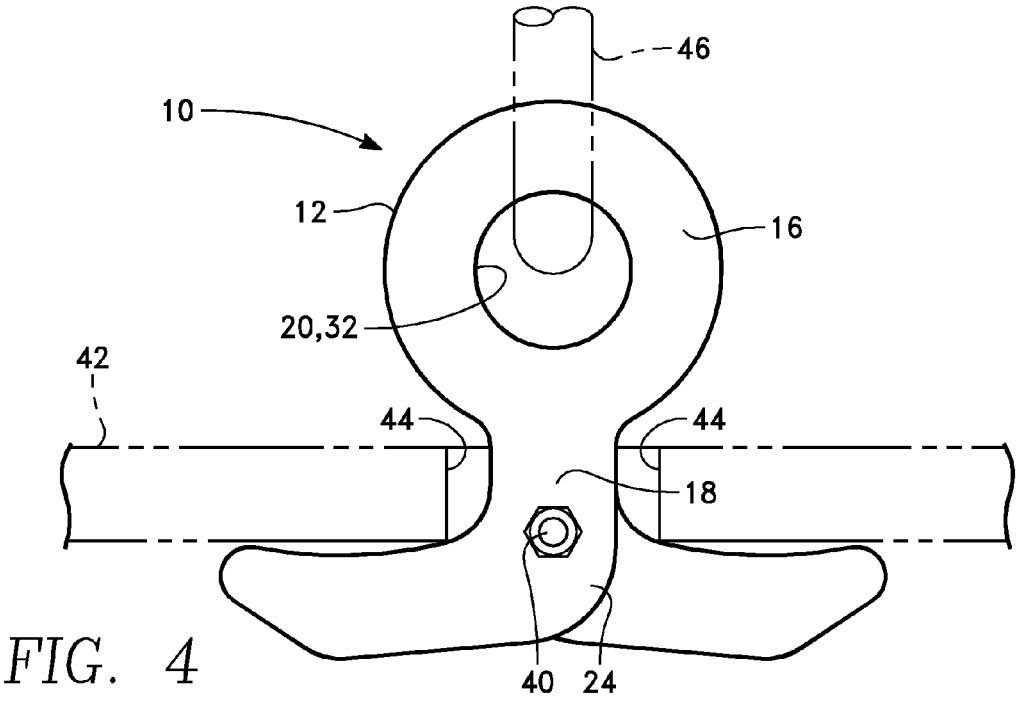
FIG. 4 is an elevational view of one embodiment of a device of the present invention positioned to engage a surface of an object to be lifted.

On aspect of the present invention includes a method of lifting an object, such as a cable reel, having an opening extending through a surface thereof. The method includes providing a device of the present invention, one embodiment of which is described above and shown in the figures. FIGS. 3 through 4 illustrate a method of use of an exemplary embodiment of a device of the present invention in conjunction with a typical cable reel. It is contemplated that the general principles described below apply to use of device 10 in lifting other objects as well.

As shown in FIG. 3, a portion of device 10 is inserted into an opening of an object to be lifted. The portion of device 10 that is inserted into the opening generally includes the portions of both pivotable hooks 12 and 14 that extend from bends 24 and 36 to points 26 and 38. Collars 16 and 28 are unaligned by exerting force on the two collars, each in an opposite direction, and causing pivotable hooks 12 and 14 to pivot in opposing directions around fastener 40. Once pivotable hooks 12 and 14 have pivoted sufficiently, as shown in FIG. 3, portions of pivotable hooks 12 and 14 can be inserted into opening 44 of cable reel 42.

Once a portion of device 10 have been inserted into opening 44 of cable reel 42, first and second pivotable hooks 12 and 14 must be pivoted once more in order for device 10 to engage cable reel 42. As shown in FIG. 4, first and second hooks 12 and 14 are pivoted such that first and second collars 16 and 28 are substantially aligned. This rotational movement of pivotable hooks 12 and 14 causes points 26 and 38 to engage an under-surface of a flange of cable reel 42, the upper surface of the portion of pivotable hooks 12 and 14 between bends 24 and 36 and points 26 and 38 acting as a seat to support cable reel 42. Once collars 16 and 28 are substantially aligned, a cable 46 can be passed through openings 20 and 32 of collars 16 and 28. The cable is then used to apply upward force to device 10, thereby lifting cable reel 42.

Figure 5:
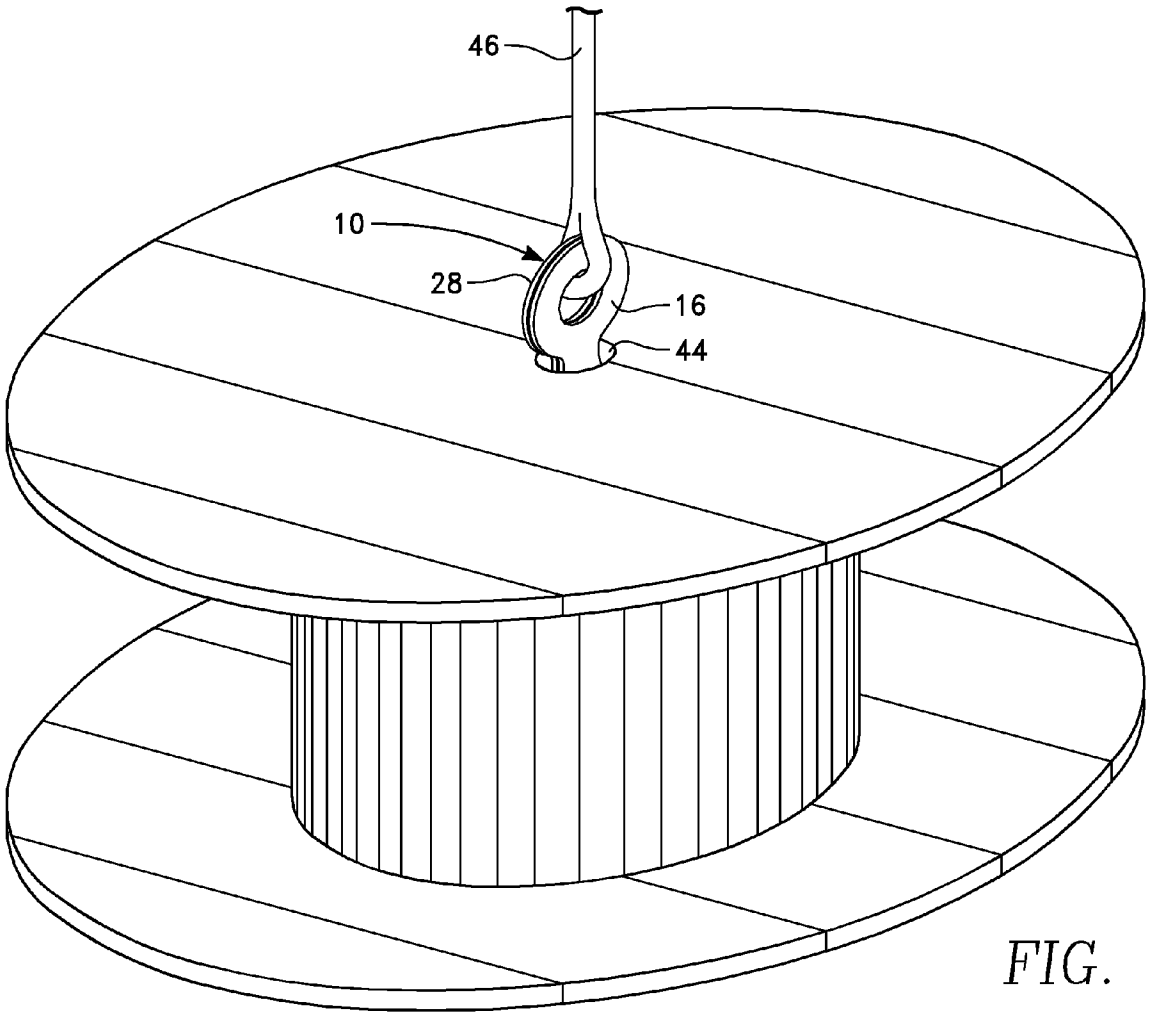
FIG. 5 is a perspective view of a cable reel having a device of the present invention inserted into an opening thereof.

FIG. 5 is a perspective view of a typical cable reel 42 having a device 10 according to the present invention associated therewith. Collars 16 and 28 of device 10 are visible protruding from opening 44 of cable reel 42. Cable 46 is shown in operable position, inserted through openings 20 and 32 of collars 16 and 28 for applying upward force to device 10. Though the remainder of device 10 is not visible as it is contained within an interior space of cable reel 42, it is contemplated that device 10 is oriented substantially as shown in FIG. 4, described above.

It is contemplated that the various components of device 10 can be constructed from any suitable material and by any suitable method of construction. In an exemplary embodiment of device 10, first pivotable hook 12 and second pivotable hook 14 are constructed from 3/16" A36 steel plate. Pivotable hooks 12 and 14 may be cut or formed from the steel plate by use of a gas or plasma torch, saw, shears, or a punch press adapted to produce the correct geometrical configuration for pivotable hooks 12 and 14. Pivotable hooks 12 and 14 may be produced manually or via a computer numerical controlled (CNC) device or process. Openings in the first and second pivotable hooks 12 and 14, such as openings 22 and 34 through which fastener 40 extends, may be made by a drill press or other suitable device. Further, although pivotable hooks 12 and 14 are described and shown herein as each being a single, unitary piece, it is contemplated that pivotable hooks 12 and 14 may instead be formed from multiple pieces, such as multiple metal components affixed to one another through welding or other means.

As noted above, first and second pivotable hooks 12 and 14 of the present invention are not limited to 3/16" A36 steel. Other exemplary materials suitable for use with the present invention include a variety of ferrous metals and alloys, as well as non-ferrous metals and alloys such as, for example, aluminum and titanium. Further, any desired thickness of metal plate or sheet may be used. Choices of material and material thickness impact specifications of the resulting device 10, including the lifting capacity of the device. Thus, it is contemplated that various materials, thicknesses of material, and the like may be varied depending on the particular application for which any given embodiment of device 10 is constructed.

Fastener 40 as shown in the drawings is a hex bolt secured with a nylock nut. It is contemplated, however, that any suitable fastener may be used to secure first and second pivotable hooks 12 and 14 such that they are able to pivot around the fastener. Various suitable fasteners will be apparent to one of skill in the art upon reading this disclosure.

The foregoing description of the present device is exemplary and provides a detailed illustration of certain embodiments of the present invention. It is contemplated, however, that a variety of modifications to the present invention will be ascertainable to one of skill in the art upon reading this disclosure. Further, the details provided above are not intended to be limiting, and many features or aspects of the device may be modified without departing from the spirit or scope of the present invention.

The invention claimed is:

1. A device for engaging an object having an opening through a surface thereof, the device comprising:

a first pivotable hook comprising a first collar at a first end thereof and extending to a first point at a second end thereof, and further comprising a first bend between said first collar and said first point, the first pivoting hook defining a first opening substantially at said first bend, and further comprising a first upper surface between the first bend and the first point;

a second pivotable hook comprising a second collar at a first end thereof and extending to a second point at a second end thereof, and further comprising a second bend between said second collar and said second point, the second pivoting hook defining a second opening substantially at said second bend, and further comprising a second upper surface between the second bend and the second point; and a fastener extending through said first opening and said second opening such that said first and second pivoting hooks pivot around said fastener, wherein when said first and second collars are substantially aligned and the device is engaging an object, at least a portion of the engaged object rests on the first and second upper surfaces.

2. The device according to claim 1, wherein when the first and second pivotable hooks are attached via said fastener and the first and second collars substantially aligned, the first point extends in a first direction and the second point extends in a second, substantially opposite, direction.

3. The device according to claim 1, wherein when in operable configuration said first pivotable hook is a mirror image of said second pivotable hook.

4. A method of lifting an object having an opening extending through a surface thereof, the method comprising the steps of:

a) providing a device according to claim 1, above;

b) pivoting the first and second pivoting hooks of said device such that the first collar and second collar of the device are substantially unaligned and the portions of the first and second pivoting hooks extending from the first and second bends to the first and second points are able to be inserted into the opening of the object to be lifted;

c) inserting into the opening of the object to be lifted the portions of the first and second pivoting hooks extending from the first and second bends to the first and second points;

d) pivoting the first and second pivoting hooks such that the first and second collars are substantially aligned; and e) lifting the object to be lifted by applying an upward force to said first and second collars.

5. A device for engaging an object having an opening through a surface thereof, the device comprising:

a first pivotable hook, said first pivotable hook comprising a) a first collar;

b) a first shank extending from said first collar to a first point, said first shank having a first bend between said first collar and said first point, the portion of the first shank between the first collar and the first bend being substantially perpendicular to the portion of the first shank between the first bend and the first point; and c) said first shank having a first opening defined therein, the first opening located substantially at the first bend of the first shank;

a second pivotable hook, said second pivotable hook comprising a) a second collar;

b) a second shank extending from said second collar to a second point, said second shank having a second bend between said second collar and said second point, the portion of the second shank between the second collar and the second bend being substantially perpendicular to the portion of the second shank between the second bend and the second point; and c) said second shank having a second opening defined therein, the second opening located substantially at the second bend of the second shank; and a fastener extending through the first opening of the first shank and the second opening of the second shank, wherein said fastener allows said first and second pivotable hooks to pivot therearound.

6. The device according to claim 5, wherein when the first and second pivotable hooks are attached via said fastener and the first and second collars substantially aligned, the portion of the first shank extending from the first bend to the first point extends in a first direction, and the portion of the second shank extending from the second bend to the second point extends in a second, substantially opposite, direction.

7. The device according to claim 5, wherein when in operable configuration said first pivotable hook is a mirror image of said second pivotable hook.

* * * * *